US010770835B2

(12) United States Patent
Schroeder

(10) Patent No.: US 10,770,835 B2
(45) Date of Patent: Sep. 8, 2020

(54) PLUG CONNECTOR PART HAVING HOUSING BODY AND HOUSING PART WHICH TOGETHER FORM HOUSING FOR RECEIVING PLUG CONTACT ELEMENT THEREIN

(71) Applicant: Kostal Kontakt Systeme GmbH, Luedenscheid (DE)

(72) Inventor: Georg Schroeder, Drolshagen (DE)

(73) Assignee: Kostal Kontakt Syteme GmbH, Luedenscheid (DE)

( * ) Notice: Subject to any disclaimer, the term of this patent is extended or adjusted under 35 U.S.C. 154(b) by 0 days.

(21) Appl. No.: 16/819,311

(22) Filed: Mar. 16, 2020

(65) Prior Publication Data

US 2020/0220302 A1 Jul. 9, 2020

Related U.S. Application Data

(63) Continuation of application No. PCT/EP2018/077853, filed on Oct. 12, 2018.

(30) Foreign Application Priority Data

Oct. 17, 2017 (DE) ..... 10 2017 009 623

(51) Int. Cl.
*H01R 13/627* (2006.01)
*H01R 13/422* (2006.01)
*H01R 13/639* (2006.01)

(52) U.S. Cl.
CPC ..... *H01R 13/6272* (2013.01); *H01R 13/422* (2013.01); *H01R 13/639* (2013.01)

(58) Field of Classification Search
CPC ..... H01R 13/426; H01R 13/6272
(Continued)

(56) References Cited

U.S. PATENT DOCUMENTS 5,632,536 A * 5/1997 Kitamura ..... H01R 13/4362 439/752
6,080,023 A * 6/2000 Meulemeester ... H01R 13/4362 439/752

(Continued)

FOREIGN PATENT DOCUMENTS

DE 8710621 U1 12/1988
DE 20106749 U1 8/2002

(Continued)

OTHER PUBLICATIONS

European Patent Office, International Search Report for International Application No. PCT/EP2018/077853, dated Dec. 21, 2018.

(Continued)

*Primary Examiner* — Abdullah A Riyami
*Assistant Examiner* — Marcus E Harcum
(74) *Attorney, Agent, or Firm* — Brooks Kushman P.C.

(57) ABSTRACT

An electrical plug connector includes a housing and a plug contact. The housing includes a housing body and a housing part which together form the housing with a receiving chamber therein. The housing body and the housing part are movable relative to one another perpendicularly to a plug-in direction and can be stably fixed to one another in a pre-locking position and in an end-locking position. The plug contact is connected to an electrical connection line and has a detent spring. The plug contact is inserted along the plug-in direction into the receiving chamber. The housing part has a locking arm having a detent protrusion. The detent spring engages the detent protrusion after the plug contact is inserted into the receiving chamber in the pre-locking position. The locking arm fixes the plug contact in the receiving chamber in a form-fit manner in the end-locking position.

7 Claims, 2 Drawing Sheets

(58) Field of Classification Search
USPC ..... 439/752
See application file for complete search history.

(56) References Cited

U.S. PATENT DOCUMENTS

| | | | | |
|---|---|---|---|---|
| 6,116,954 | A * | 9/2000 | Ries | H01R 12/778 439/423 |
| 6,368,165 | B2 * | 4/2002 | Kubo | H01R 13/4362 439/746 |
| 7,059,902 | B2 * | 6/2006 | Nakamura | H01R 13/641 439/489 |
| 7,556,538 | B2 * | 7/2009 | Nakamura | H01R 13/4362 439/595 |
| 7,591,665 | B2 * | 9/2009 | Nakamura | H01R 13/5812 439/374 |
| 2002/0086588 | A1 * | 7/2002 | Fujita | H01R 13/4362 439/752 |
| 2004/0014369 | A1 | 1/2004 | Pade | |
| 2004/0242083 | A1 * | 12/2004 | Ishiyama | H01R 13/4362 439/752 |
| 2004/0253881 | A1 * | 12/2004 | Sakurai | H01R 4/185 439/752 |
| 2005/0170703 | A1 * | 8/2005 | Nakamura | H01R 13/4362 439/752 |
| 2006/0068647 | A1 * | 3/2006 | Kojima | H01R 13/4223 439/752 |
| 2007/0281555 | A1 * | 12/2007 | Suemitsu | H01R 13/424 439/752 |
| 2008/0305694 | A1 * | 12/2008 | Takahashi | H01R 13/4362 439/752 |
| 2009/0081908 | A1 * | 3/2009 | Martin | H01R 13/506 439/752 |
| 2009/0191767 | A1 * | 7/2009 | Mase | H01R 13/4362 439/752 |

FOREIGN PATENT DOCUMENTS

| | | | | |
|---|---|---|---|---|
| DE | 102008055841 | A1 * | 5/2010 | H01R 13/506 |
| DE | 102008055841 | A1 | 5/2010 | |
| EP | 1107382 | A2 | 6/2001 | |
| FR | 3044172 | A1 | 5/2017 | |

OTHER PUBLICATIONS

German Patent and Trademark Office, German Search Report for corresponding German Patent Application No. 10 2017 009 623.6 dated Jul. 2, 2018.

* cited by examiner

PLUG CONNECTOR PART HAVING HOUSING BODY AND HOUSING PART WHICH TOGETHER FORM HOUSING FOR RECEIVING PLUG CONTACT ELEMENT THEREIN

CROSS-REFERENCE TO RELATED APPLICATIONS

This application is a continuation of International Application No. PCT/EP2018/077853, published in German, with an International filing date of Oct. 12, 2018, which claims priority to DE 10 2017 009 623.6, filed Oct. 17, 2017; the disclosures of which are hereby incorporated in their entirety by reference herein.

TECHNICAL FIELD

The present invention relates to an electrical plug connector part having a housing body and a housing part which together form a housing and further having an electrical plug contact element that is connected to an electrical connection line and has a molded-on detent spring, wherein the housing forms a receiving chamber into which the plug contact element is inserted, the detent spring is engaged on a detent protrusion after the plug contact element is inserted into the receiving chamber, and the housing part can be locked to the housing body and has a locking arm that fixes the plug contact element in the receiving chamber in a form-fit manner in an end-locking position of the housing part.

BACKGROUND

Such an electrical plug connector part is known from German unexamined patent application DE 10 2008 055 841 A1. This plug connector part has a housing made up of a housing body and a housing part. The housing body has receiving chambers and integrally-formed detent protrusions for fastening plug contact elements that are connected to electrical connection lines. Detent springs of the plug contact elements, which protrude from the plug contact elements in the manner of lances, lock onto the detent protrusions. The housing part is movably mounted onto the housing body, for example via a film hinge, or is attachable as an individual part to a bearing point on the housing body. In any case, the housing part is pivotable relative to the housing body for assembly. This means that until the housing body and the housing part are mutually locked, the housing body and the housing part form an arrangement in which they are slightly movable with respect to one another, which makes handling relatively difficult during assembly.

SUMMARY

An object is a generic electrical plug connector part having a particularly simple design and assembly.

In carrying out at least one of the above and/or other objects, embodiments of the present invention provide an electrical plug connector part. The plug connector part includes a housing body and a housing part which together form a housing. The plug connector part further includes an electrical plug contact element(s) connected to an electrical connection line(s). The plug contact element includes a detent spring (latching spring, engaging spring) formed thereon. The housing forms a receiving chamber(s) into which the plug contact element is introduced. The detent spring is engaged (latched, locked) on a detent protrusion (latching projection, engaging protrusion) after the introduction of the plug contact element into the receiving chamber. The housing part is engageable with the housing body. The housing part has a locking arm(s) which inter-lockingly secures the plug contact element in the receiving chamber in an end-engagement position of the housing part. The housing body and the housing part are arranged such that they can shift relative to one another perpendicularly to the plugging direction of the plug connector part and can be secured to one another in a stable manner in a pre-engagement position and in an end-engagement position. The locking arm forms the detent protrusion, for the detent spring of the plug contact element, on the housing body.

In the electrical plug connector part in accordance with embodiments of the present invention, the housing body and the housing part are situated so as to be movable relative to one another perpendicularly to the plug-in direction of the plug connector part and can be stably fixed to one another in a stable, pre-locking (pre-latching, pre-engagement) position and in a stable, end-locking (end-latching, end-engagement) position and the locking arm together with the housing body form a detent protrusion for the detent spring of the plug contact element.

In contrast to the plug connector part known from DE 10 2008 055 841 A1, for assembling the plug contact element of the plug connector part in accordance with embodiments of the present invention it is not necessary to attach the housing part to a bearing point or fold the housing part against the housing body. At the time of assembly of the plug contact element, the housing body and the housing part are pre-mounted in a stable pre-locking position with one another. In the pre-locking position, the locking arm, formed by the housing part, together with the housing body forms a detent protrusion on which the plug contact element can engage.

With a small external application of force, the housing body and the housing part may be brought into the end-locking position relative to one another, in which the locking arm fixes the plug contact element in the receiving chamber of the housing body in a form-fit manner.

The fixing of the plug contact element takes place in that during the transition into its end-locking position, the locking arm moves behind a contact box that is molded onto the plug contact element, thus enclosing the contact box in a receiving chamber of the housing body in a form-fit manner.

It is advantageous that the final assembly of the plug contact element in the plug connector part in accordance with embodiments of the present invention takes place in a particularly rapid and simple manner. Since the two housing elements, namely, the housing body and the housing part, are already connected to one another in a pre-locking position when the plug contact element is inserted into the receiving chamber in the housing, the final assembly step consists of a brief application of force by pressing on the circumferential surface of the housing. The two housing elements are thus released from their pre-locking position and mutually brought into their end-locking position; at the same time, the plug contact element is fixed within the housing in a form-fit manner.

It is particularly advantageous that the housing elements may be designed in such a way that during this final assembly step, the electrical connection line connected to the plug contact element is at the same time enclosed between the housing elements in a clamping manner.

It is also advantageous that the locking arm of the housing part carries out multiple functions here. In the pre-locking position, the locking arm forms a detent protrusion on the housing body that is used for fixing the detent spring of the plug contact element. As a result, such protrusions do not have to be integrally molded on the housing body or provided by moldings on the housing body. This makes the manufacture of the housing body easier and more cost-effective. In the end-locking position, the locking arm fixes the detent spring as well as the contact box of the plug contact element.

The plug connector part in accordance with embodiments of the present invention thus allows easy assembly, and at the same time, a particularly simple design of its components.

BRIEF DESCRIPTION OF THE DRAWINGS

Advantageous embodiments and refinements of the present invention result from the following description of an exemplary embodiment, with reference to the drawings which show the following.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
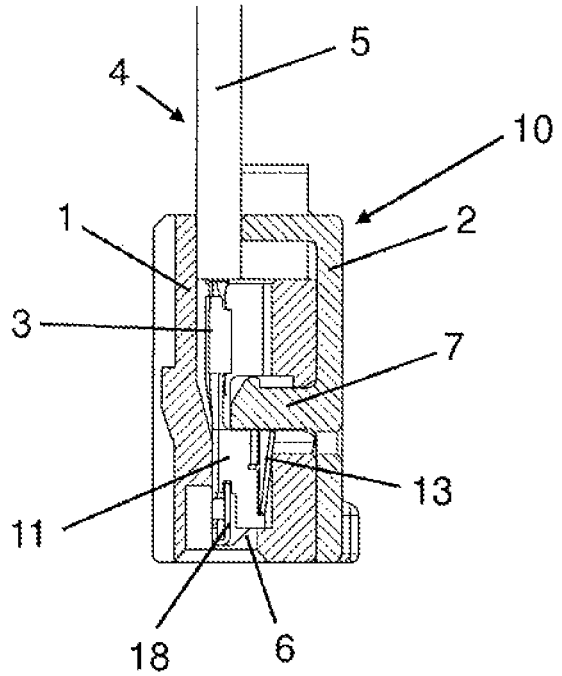
FIG. 1 illustrates a sectional view of a plug connector part.

Referring now to FIG. 1, an electrical plug connector part in accordance with an exemplary embodiment is shown. FIG. 1 shows a sectional view of the completely assembled plug connector part. The plug connector part includes a housing 10 made up of two housing elements 1, 2. The two housing elements 1, 2 are a housing body 1 and a housing part 2. Housing body 1 and housing part 2 are joined together. Housing body 1 and housing part 2 are arranged such that they can shift relative to one another perpendicular to the plugging direction of the plug connector part and can be secured to one another in a stable manner in a pre-locking position and in an end-locking position. The end-locking position is shown in FIG. 1. A receiving chamber 6 is formed inside housing 10.

The plug connector part further includes an electrical plug contact element 3. Plug contact element 3 is connected to an electrical connection line 4. Plug contact element 3 is situated in receiving chamber 6 inside housing 10 thus formed. A section 5 of electrical connection line 4, provided with insulating casing, is led out from housing 10 between housing elements 1, 2.

Figure 2:
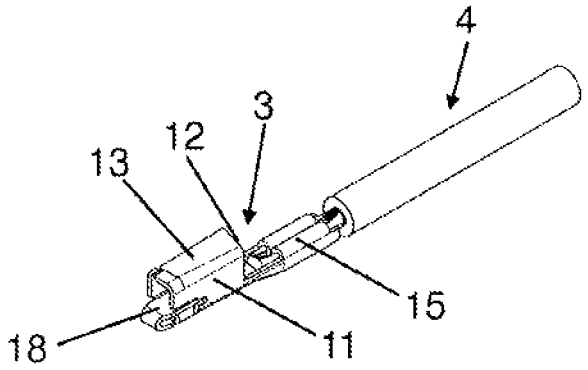
FIG. 2 illustrates a plug contact element of the plug connector part together with an electrical connection line.

FIG. 2 illustrates an individual view of plug contact element 3 with electrical connection line 4 connected thereto. Plug contact element 3 includes a contact box 11. Contact box 11 has an inwardly bent, strip-shaped contact tongue 18 situated on a front section of plug contact element 3. The end section of plug contact element 3 situated opposite from contact box 11 is a crimp section 15. Electrical connection line 4 is mechanically fastened and electrically connected to crimp section 15 via a wire crimp or Litz wire crimp.

Plug contact element 3 is designed as a stamped/bent part that is preferably formed in one piece. The upper surface of contact box 11 is formed by a molded-on metal strip 13. The longitudinal and transverse edges of metal strip 13 are oriented at an angle to one another. As a result, various points of metal strip 13 are situated at different heights above the base surface of plug contact element 3. The further protruding sections of metal strip 13 may thus be moved by an application of force against the other sections and may deflect due to the elastic connection of metal strip 13 to plug contact element 3. Metal strip 13 on the upper surface of plug contact element 3 thus forms a detent spring 13 (latching spring, engaging spring). Detent spring 13 is provided for the primary locking of plug contact element 3 in receiving chamber 6 within housing 10.

As shown in FIG. 1, housing part 2 includes a locking arm 7. Locking arm 7 inter-lockingly secures plug contact element 3 in receiving chamber 6 within housing 10 in the end-locking position. Locking arm 7 forms a detent protrusion 14 on housing body 1. Detent spring 13 of plug contact element 3 engages on detent protrusion 14 after the introduction of plug contact element 3 into receiving chamber 6.

FIGS. 3*a*, 3*b*, 3*c*, 3*d*, and 3*e* each illustrate a sectional view of the plug connector part during respective assembly phases. As such, FIGS. 3*a*, 3*b*, 3*c*, 3*d*, and 3*e* illustrate the sequence in the assembly of the plug connector part by joining together housing body 1 and housing part 2 together with plug contact element 3.

As mentioned, housing body 1 and housing part 2 may be positioned with respect to one another in two locking positions, referred to here as the pre-locking position and the end-locking position, perpendicular to the intended plug-in direction of the plug connector part, for which purpose cooperating mechanical detent elements (not discernible in the sectional illustrations of the drawings) are situated on housing body 1 and on housing part 2. Since their specific configurations are not relevant for understanding the present invention, a more detailed description is dispensed with here.

During assembly of plug contact element 3, housing body 1 and housing part 2 are already connected to one another in their pre-locking position. The pre-locking position, illustrated in FIGS. 3*a*, 3*b*, 3*c*, and 3*d*, is a first stable arrangement of housing body 1 and housing part 2 relative to one another. The pre-locking position is characterized in that housing body 1 and housing part 2 in the connection direction perpendicular to the intended plug-in direction of the plug connector part are not situated at the closest possible distance from one another.

Figure 3A:
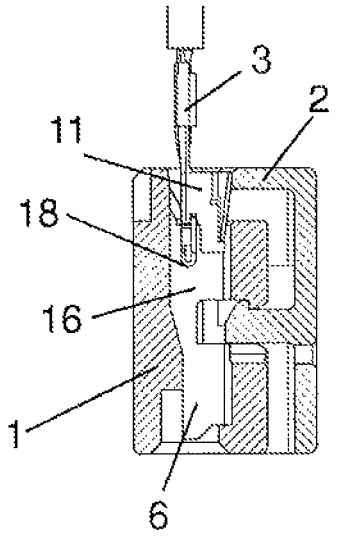
FIGS. 3*a*, 3*b*, 3*c*, 3*d*, and 3*e* each illustrate a sectional view of the plug connector part during respective assembly phases.
Figure 3B:
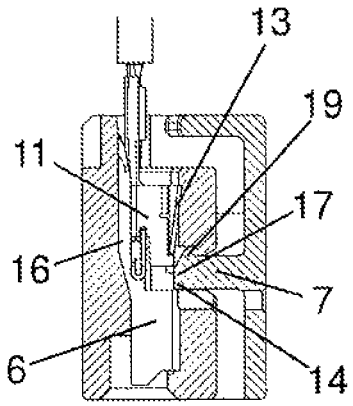

As shown in the sectional view in FIG. 3*a*, the two housing elements 1, 2 form a channel-like, free space 16. The end of free space 16 forms a receiving chamber 6. A free end section 17 of locking arm 3 protrudes slightly into free space 16.

Free end section 17 of locking arm 7 forms a hook-like edge. The hook-like edge, together with a correspondingly shaped edge of housing body 1, forms a barb-like connection 19. Due to a form-fit connection, barb-like connection 19 prevents housing body 1 from being accidentally disconnected from housing part 2.

Plug contact element 3 together with its contact tongue 18 and its contact box 11 may be pushed forward into free space 16. Contact box 11 of plug contact element 3 is to be fastened within receiving chamber 6. When plug contact element 3 is inserted into free space 16, contact box 11 in FIG. 3*b* reaches locking arm 7.

Figure 3C:
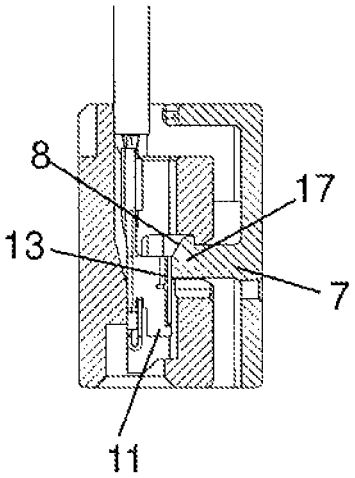

Free end section 17 of locking arm 7 forms a detent protrusion 14 (latching protrusion, engaging protuberance) on a wall section of housing body 1 in the direction of receiving chamber 6. Free end section 17 of locking arm 7 on its side facing away from receiving chamber 6 has a guide bevel 8. Guide bevel 8 allows detent spring 13, that is molded onto contact box 11 of plug contact element 3, to lie closely against contact box 11 while passing by locking arm 7. Thus, as shown in FIG. 3*c*, detent spring 13 can slide past free end section 17 of locking arm 7 without being caught on the locking arm.

Figure 3D:
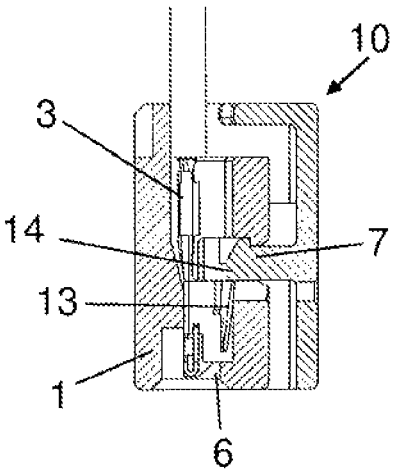

Upon further insertion of plug contact element 3, detent spring 13 ultimately locks behind detent protrusion 14 formed by locking arm 7, shown in FIG. 3*d*. Plug contact element 3 is thus secured within housing 10 against falling out.

For a multipole plug connector part, further plug contact elements 3 are similarly inserted into further receiving chambers 6 of housing 10, depending on the number of poles provided. Each plug contact element 3 is initially held in its receiving chamber 6 by the primarily locking brought about by its detent spring 13.

For a multipole plug connector part, housing part 2 may either have a single wide locking arm 7 that forms parallel detent protrusions 14 on all receiving chambers 6, or multiple narrow, parallel locking arms 7 may be provided, each of which cooperates with one of receiving chambers 6.

Figure 3E:
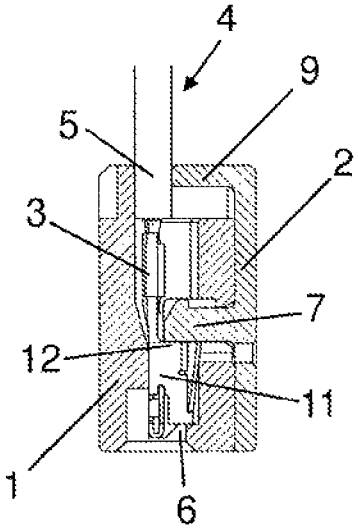

To complete the assembly, housing body 1 and housing part 2 are pressed together by an external application of force, and are thus brought into their end locking position, shown in FIG. 3*e*. Locking arm 7 thus moves over contact shoulder 12, which is formed by the end section of contact box 11, and fixes plug contact element 3 in receiving chamber 6 in a form-fit manner. Thus, due to the fixing of detent spring 13 on the one hand and the fixing of contact box 11 to contact shoulder 12 on the other hand, locking arm 7 brings about primary as well as secondary locking of plug contact element 3. Both lockings take place within housing 10 in a single locking plane, which advantageously contributes to achieving a particularly compact design of the plug connector part.

In the end-locking position illustrated in FIGS. 1 and 3*e*, once again stable positioning of housing elements 1, 2 relative to one another is achieved, with housing elements 1, 2 now forming a compact arrangement with one another.

When the end-locking position is reached, an upper section 9 of housing part 2 also closely attaches to an encased section 5 of electrical connection line 4 and presses it against housing body 1. Electrical connection line 4 is thus fixed between housing elements 1, 2 in a force-fit manner. The assembly of the plug connector part is complete when the end-locking position is reached.

LIST OF REFERENCE NUMERALS

1 housing body
2 housing part
1, 2 housing elements
3 plug contact element(s)
4 electrical connection line(s)
5 section (of the electrical connection line)
6 receiving chamber(s)
7 locking arm(s) (bar)
8 guide bevel
9 upper section (of the housing part)
10 housing
11 contact box
12 contact shoulder
13 detent spring (metal strip)
14 detent protrusion
15 crimp section
16 channel-like free space
17 end section (of the locking arm)
18 contact tongue
19 barb-like connection While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. An electrical plug connector part comprising:

a housing body having a wall section;

a housing part having a locking arm including a free end section;

the housing body and the housing part together form a housing having a channel and a receiving chamber at an end of the channel with the channel and the receiving chamber being bounded by the wall section of the housing body, the housing body and the housing part are situated so as to be movable relative to one another perpendicularly to a plug-in direction and can be stably fixed to one another in a pre-locking position and in an end-locking position;

a plug contact element having a detent spring, the plug contact element is insertable along the plug-in direction into the channel and from the channel into the receiving chamber;

wherein in the pre-locking position the free end section of the locking arm forms on the wall section of the housing body a detent protrusion protruding out from the wall section and into the channel and the detent spring of the plug contact element engages the detent protrusion as the plug contact element is inserted from the channel into the receiving chamber; and in the end-locking position the free end section of the locking arm with the detent protrusion extends further into the channel and the locking arm fixes the plug contact element in the receiving chamber in a form-fit manner by the detent spring of the plug contact element being locked behind the free end section of the locking arm when the plug contact element is inserted into the receiving chamber.

2. The electrical plug connector part of claim 1 wherein: the plug contact element has a one-piece design.

3. The electrical plug connector part of claim 1 wherein: the detent spring is formed by a surface section of the plug contact element, whose boundary lines extending longitudinally are oriented at an angle to one another.

4. The electrical plug connector part of claim 1 wherein: the plug contact element is connected to an electrical connection line.

5. The electrical plug connector part of claim 4 wherein: in the end-locking position, the housing part and the housing body in cooperation fasten a section of the electrical connection line, encased with insulation, in a clamping manner.

6. The electrical plug connector part of claim 1 wherein:

the free end section of the locking arm of the housing part has a guide bevel to facilitate sliding engagement of the detent spring with the detent protrusion so that the plug contact element can be inserted from the channel into the receiving chamber without being caught on the detent protrusion.

7. The electrical plug connector part of claim 1 wherein:

the plug contact element further includes a contact box from which the detent spring of the plug contact element extends; and the locking arm fixes the plug contact element in the receiving chamber in the form-fit manner by the contact box of the plug contact element also being locked behind the free end section of the locking arm.

* * * * *